US007373739B2

(12) United States Patent
Doerer et al.

(10) Patent No.: US 7,373,739 B2
(45) Date of Patent: May 20, 2008

(54) SHOE SOLE HAVING FABRIC AND METHOD FOR ADHERING FABRIC TO SHOE SOLE

(75) Inventors: Daniel M. Doerer, Town & Country, MO (US); Duane Shelton, Bourbon, MO (US); Robert P. Wagner, Shiloh, IL (US); Phillip W. Pugh, St. Louis, MO (US)

(73) Assignee: Brown Shoe Company, Inc., St. Louis, MO (US)

( * ) Notice: Subject to any disclaimer, the term of this patent is extended or adjusted under 35 U.S.C. 154(b) by 342 days.

(21) Appl. No.: 11/314,439

(22) Filed: Dec. 21, 2005

(65) Prior Publication Data

US 2007/0136960 A1 Jun. 21, 2007

(51) Int. Cl.
*A43B 13/00* (2006.01)
*A43D 11/00* (2006.01)

(52) U.S. Cl. ..... 36/25 R; 36/30 R; 36/59 R; 12/142 R; 12/146 BR

(58) Field of Classification Search ..... 36/25 R, 36/59 R, 30 R; 12/142 R, 146, 146 BR
See application file for complete search history.

(56) References Cited

U.S. PATENT DOCUMENTS

| | | | | |
|---|---|---|---|---|
| 2,121,678 | A * | 6/1938 | Armor | 36/30 R |
| 2,844,833 | A | 7/1958 | Odermatt | |
| 3,177,598 | A * | 4/1965 | Ferreira | 36/30 R |
| 3,886,122 | A | 5/1975 | Fabris et al. | |
| 3,890,664 | A * | 6/1975 | Hanson | 12/146 |
| 3,919,035 | A * | 11/1975 | Warrach | 156/315 |
| 5,906,872 | A | 5/1999 | Lyden et al. | |
| 6,287,698 | B1 * | 9/2001 | Zhu et al. | 428/424.4 |
| 6,412,196 | B1 * | 7/2002 | Gross | 36/102 |
| 6,430,844 | B1 | 8/2002 | Otis | |
| 6,571,491 | B2 | 6/2003 | Safdeye et al. | |
| 6,590,057 | B1 * | 7/2003 | Brecht et al. | 528/52 |
| 6,944,975 | B2 * | 9/2005 | Safdeye et al. | 36/59 R |
| 2002/0152638 | A1 * | 10/2002 | Safdeye et al. | 36/59 R |
| 2003/0009919 | A1 * | 1/2003 | Stein | 36/59 R |
| 2004/0020080 | A1 * | 2/2004 | Cox et al. | 36/103 |
| 2004/0128864 | A1 * | 7/2004 | Kimura et al. | 36/113 |
| 2005/0182173 | A1 | 8/2005 | Yashima et al. | |
| 2006/0260151 | A1 * | 11/2006 | Chou | 36/30 R |

FOREIGN PATENT DOCUMENTS

WO 2004071224 8/2004

OTHER PUBLICATIONS

International Search Report from corresponding International Application No. PCT/US 06/48317, mailed Oct. 31, 2007.
International Written Opinion from corresponding International Application No. PCT/US 06/48317, mailed Oct. 31, 2007.

* cited by examiner

*Primary Examiner*—Marie Patterson
(74) *Attorney, Agent, or Firm*—Polster, Lieder, Woodruff & Lucchesi, L.C.

(57) ABSTRACT

An outsole for a shoe has a bottom surface with a fabric insert glued into a recess. The method of gluing the fabric insert to the shoe outsole comprises cleaning the recess of the outsole, priming the recess to receive glue, applying glue to the recess; applying glue to the fabric insert; and pressing the fabric insert into the recess to fix the fabric insert in the recess.

18 Claims, 2 Drawing Sheets

SHOE SOLE HAVING FABRIC AND METHOD FOR ADHERING FABRIC TO SHOE SOLE

BACKGROUND OF THE INVENTION

This application relates to shoe soles, and in particular to a plastic shoe sole having fabric applied thereto.

Typically, a shoe includes an outsole and a shoe upper or vamp secured to the outsole. The outsole of the shoe is an exposed portion of the shoe which makes contact with the ground. For this reason, the outsole is designed and manufactured with various performance characteristics, such as, traction, stability, and wear resistance. Economic factors also affect the design and manufacture of shoe outsoles. The economics of shoe manufacturing can be affected by placing fabric on the bottom surface of the outsole.

SUMMARY OF THE INVENTION

Briefly stated, a method is provided for gluing a fabric insert to the bottom surface of a shoe outsole. In particular, the shoe outsole is formed with a recess which receives the fabric insert. A groove or channel can extend around the recess to facilitate hiding of the edge of the fabric insert to prevent fraying of the fabric and to form a clean edge to the fabric insert. Raised tread forming members can be provided which extend from the recess. The tread forming members can, for example, be ribs which extend from the recess. In this instance, the fabric insert will have slots or openings through which the tread forming members extend. Tread surfaces can also be provided by printing a tread pattern on the fabric insert.

The method for producing the outsole includes preparing the outsole for glue by removing oils and particles from the outsole recess. For example, the recess can be wiped with methyl ethyl ketone. The recess is then primed by coating the recess with a polyurethane cement primer. Lastly, a glue, such as a polyurethane cement is applied over the primer. Polyurethane cement is also applied to one surface of the fabric insert. The fabric insert is pressed into the recess so that the polyurethane cement applied to the fabric insert contacts and binds with the polyurethane cement in the shoe recess. The outsole and the fabric insert can be dried between steps.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
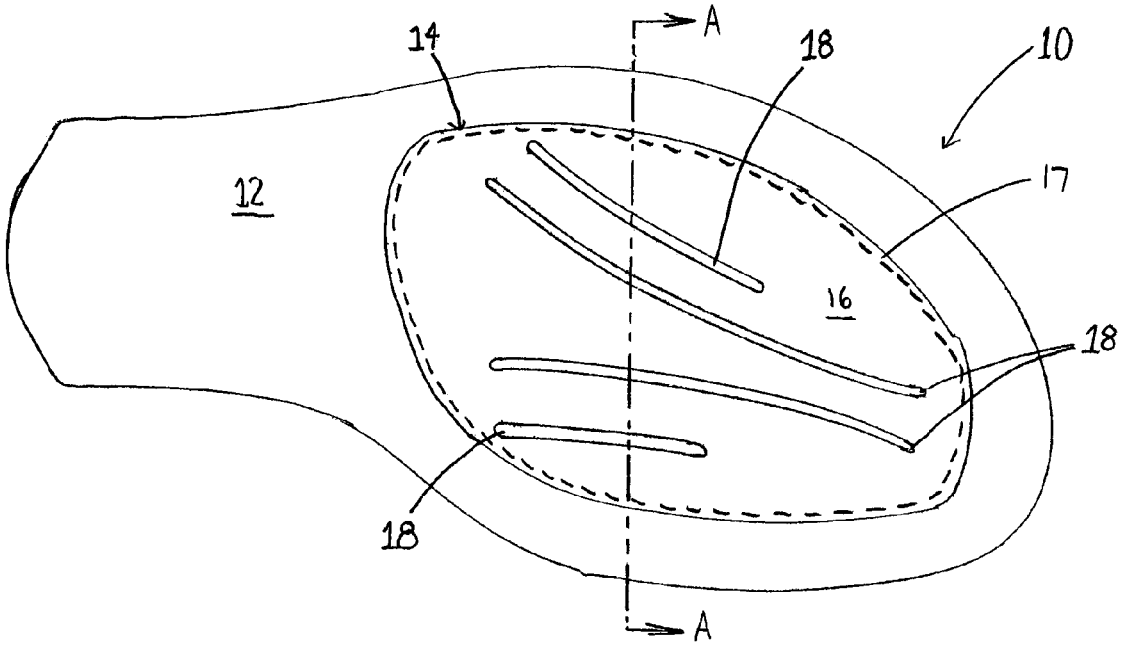
FIG. 1 is a bottom view of an outsole according to the present invention.
Figure 2:
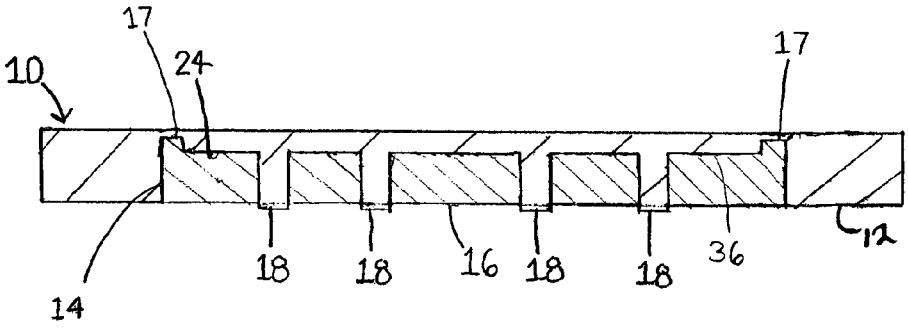
FIG. 2 is an enlarged sectional view of the outsole along A-A of FIG. 1.
Figure 3:
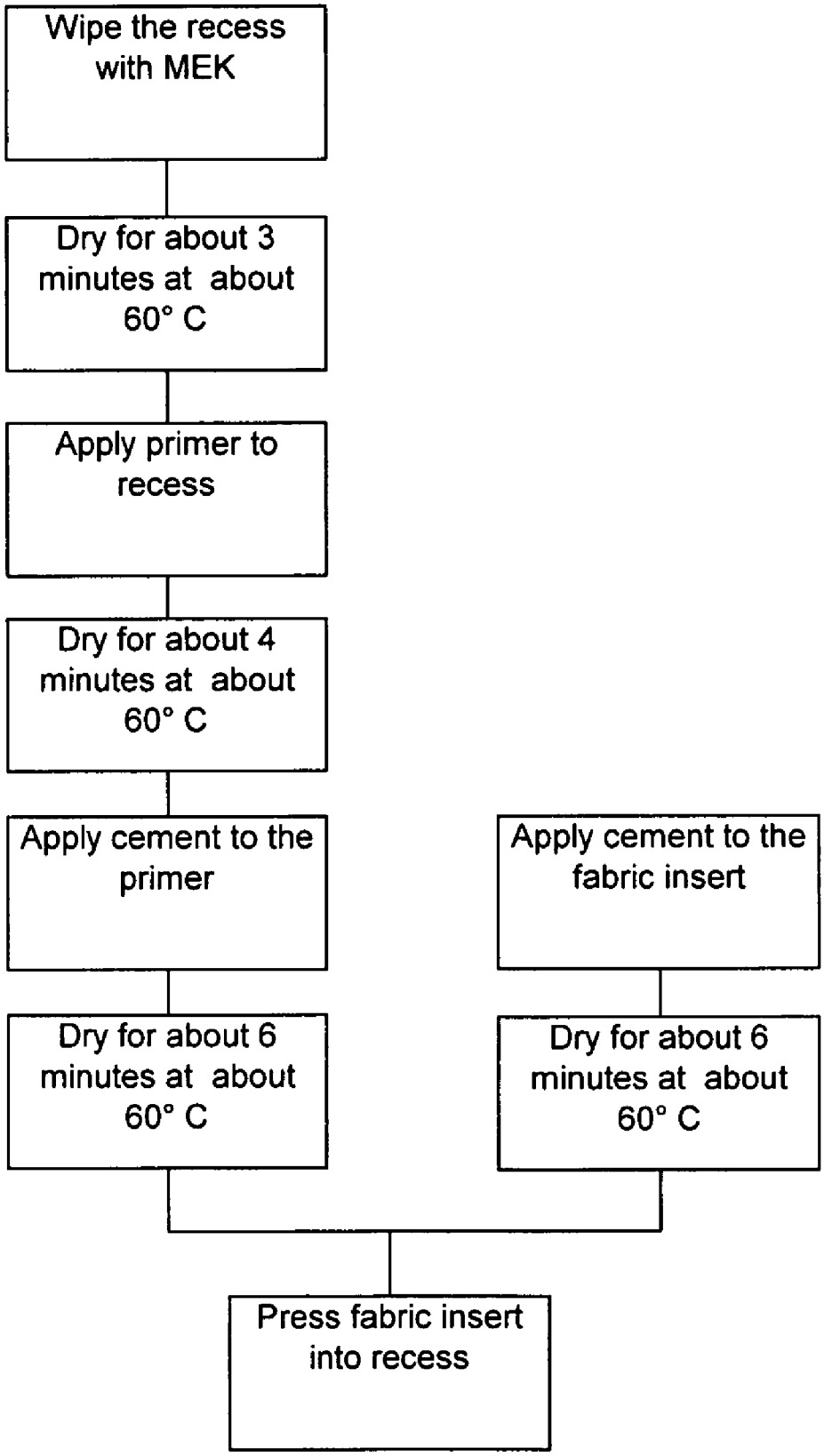
FIG. 3 is a flow chart showing the steps of making the outsole of FIG. 1.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A shoe outsole 10 includes a bottom surface 12 having a recess 14 formed therein. The recess 14 receives a fabric insert 16. A groove or channel 17 extends around the periphery of the recess 14. Raised tread members 18 can extend from the recess 14 to protrude slightly beyond the outer, bottom, surface of the fabric insert. Tread members can be formed in other ways as well. For example, a rubber or plastic tread pattern can be printed on the fabric insert 16. If raised tread members 18 are used, the fabric insert 16 includes slots or openings through which the tread members 18 protrude. These slots or openings will correspond in shape to the raised tread member so that the edge of the slot or opening will be adjacent the sides of the raised tread member. In the embodiment of FIG. 1, four rib-shaped raised tread members 18 are shown. They are about ¼" wide and of different lengths between about 1½" to about 3" and extend lengthwise relative to the recess 14. However, those skilled in the art will recognize that other shapes, sizes, and arrangements of raised tread members 18 can be used.

The outsole 10 is preferably made from thermoplastic rubber (TPR) or poly vinyl chloride (PVC), but other plastic materials known to those skilled in the art can also be used. The fabric insert 16 can be any desired woven or non-woven material that will withstand the expected wear.

The fabric insert 16 is secured or fixed in the recess 14 of the outsole 10 by a gluing process, as described below. First, a solution of methyl ethyl ketone (MEK) is applied to a contact surface 24 of the recess 14 with a brush, roller, spray, or other appropriate means to remove any surface oils from the recess contact surface 24. The outsole 10 is then allowed to dry. The drying of the outsole can be expedited, for example, by placing it into a drying apparatus at about 60° C. for approximately three (3) minutes.

After drying of the outsole, a primer is applied to the contact surface 24 with a brush, roller, spray, or other appropriate means. In the preferred embodiment, the primer is a mixture of chlorinated solvent and polyurethane cement having 2% Desmodur®, a brand name for a group of isocyanates and isocyanate prepolymers for urethane adhesives available from Bayer Aktiengesellschaft. The chlorinated solvent effectively opens pores of the contact surface 24, which receive the cement. This allows for the glue (i.e., cement) in the primer to penetrate the outsole to form a better connection between the glue and the outsole, and ultimately to form a better bonding of the fabric insert 16 to the outsole 10. The outsole 10 is again dried. As noted above, drying can be accomplished by placing the outsole into the drying apparatus at about 60° C. for approximately four (4) minutes.

Next, one or more coats of polyurethane cement having 2% Desmodur®, are applied to the primer with a brush, roller, spray, or other appropriate means. The outsole 10 is again allowed to dry. Drying can be expedited by placing the outsole into the drying apparatus at about 60° C. for approximately six (6) minutes.

One or more coats of polyurethane cement having 2% Desmodur® are also applied to a surface 36 of the fabric insert 16 with a brush, roller, spray, or other appropriate means. The fabric insert 16 is dried, for example, by placing it into the drying apparatus at about 60° C. for approximately six (6) minutes. The polyurethane cement can be applied to the fabric insert 16 at any desired time relative to the processing of the outsole.

Once the glue has been applied to the outsole 10 and fabric insert 16, the fabric insert can be fixed (i.e., glued) to the outsole 10. This is accomplished by placing the fabric insert 16 into the outsole recess 14 so that cement coated side of the fabric insert 16 contacts the cement coated contact surface 24 of the outsole recess. Initially, the fabric insert 16 is attached to the outsole 10 by pressing the fabric softly into the recess 14, for example, by hand. The outsole 10 with fabric insert 16 then is placed into a pressing machine that mechanically presses against the outsole 10 and fabric insert 16 for approximately 8-10 seconds. Sufficient pressure is applied by the press to insure proper bonding between the entire surface of the fabric insert 16 and outsole 10. Preferably, a polyurethane or silicone pad is adjacent to the fabric insert 16 during pressing. The pad is a mold that is of the same shape of the finished sole. The pad will urge the edge of the fabric insert 16 into the groove 17 about the periphery of the recess 14 to provide a clean or neat edge to the fabric and to reduce the possibility of the fabric fraying.

In the preparation process, the glue (i.e., the polyurethane cement) at least partially impregnates the fabric insert. As noted above, the glue also penetrates the pores that are opened or formed by the primer. As is apparent, the glue applied to the fabric insert is the same glue that is applied to the outsole. Hence, when the two glue coated surfaces are brought into contact, and the glue is activated under pressure, the glue of the fabric insert will bond with the glue of the outsole to thereby form a single contiguous layer or coating of glue between the outsole and the fabric insert. Thus, on one side, this glue layer will be penetrated into the outsole pores, and on the other side, the glue layer will be impregnated into the fabric insert. This will form strong connection to permanently affix the fabric insert 16 into the outsole recess 14.

Changes can be made in the above constructions without departing from the scope of the invention, it is intended that all matter contained in the above description or shown in the accompanying drawings shall be interpreted as illustrative and not in a limiting sense. For example, different chemicals can be used to clean the surface of the recess. As can be appreciated, what is important is that the surface be cleaned to accept and adhere to the glue. An alternate glue can be used. Something other than the chlorinated solvent or isocyanate can be used to prime the recess to form or open the pores in the recess 14. These examples are merely illustrative.

What is claimed is:

1. A method of securing a fabric insert to an outsole of a shoe, the method comprising:

providing a shoe outsole having a recess formed in a bottom surface thereof and a groove extending around the periphery of the recess;

cleaning a surface of the recess to remove oils therefrom;

priming to the recess;

applying a polyurethane cement to the primed recess;

applying a polyurethane cement to the fabric insert;

pressing the fabric insert into the recess and urging the edge of the fabric insert into the groove so that the polyurethane cement applied to the fabric insert contacts the polyurethane cement applied to the layer of primer.

2. The method of claim 1 wherein the step of cleaning the outsole recess comprises applying methyl ethyl ketone to the outsole recess.

3. The method of claim 1, further comprising drying the outsole for about three minutes at about 60° C. after it has been cleaned.

4. The method of claim 1, further comprising drying the outsole for about four minutes at about 60° C. after it has been primed.

5. The method of claim 1, further comprising drying the outsole for about six minutes at about 60° C. after the polyurethane cement has been applied to the recess.

6. The method of claim 1, further comprising drying the fabric insert for about six minutes at about 60° C. after the polyurethane cement has been applied to the fabric insert.

7. The method of claim 1, further comprising pressing the fabric insert into the recess for about 8-10 seconds.

8. The method of claim 1, wherein the step of applying the primer to the recess comprises applying a mixture of polyurethane cement and chlorinated solvent to the recess.

9. The method of claim 8, wherein the polyurethane cement comprises about 2% isocyanate.

10. A method of gluing a fabric insert to a bottom surface of a shoe outsole; the method comprising:

providing an outsole having a recess formed in the bottom surface and a groove extending around the periphery of the recess;

cleaning the recess;

priming the recess to receive glue;

applying glue to the recess;

applying glue to the fabric insert; and pressing the fabric insert into the recess and urging the edge of the fabric insert into the groove to fix the fabric insert in the recess.

11. The method of claim 10, wherein the step of cleaning the recess comprises applying methyl ethyl ketone to the recess.

12. The method of claim 10, wherein the step of priming the recess comprises forming pores in the recess into which the glue can penetrate.

13. The method of claim 12 wherein the step of priming the recess comprises applying a mixture of the glue and a solvent to the recess.

14. The method of claim 12, wherein the solvent is chosen from the group consisting of isocyanates, chlorinated solvents, and combinations thereof.

15. The method of claim 10, wherein the step of applying glue to the outsole recess and the fabric insert comprises coating the fabric recess and fabric insert with a polyurethane cement.

16. The method of claim 10, wherein the step of applying glue to the fabric insert comprises applying two coats of glue to the fabric insert.

17. The method of claim 10, further comprising drying the outsole and/or the fabric insert after one or more of the steps.

18. The method of claim 17 wherein the step of drying the outsole and/or fabric comprises inserting the outsole and/or fabric insert into a drying apparatus for a predetermined amount of time and at about 60° C.

* * * * *